United States Patent [19]

Simpson-Davis

[11] Patent Number: 5,029,845

[45] Date of Patent: Jul. 9, 1991

[54] SHEET FEEDING APPARATUS

[75] Inventor: Raymond Simpson-Davis, Southampton, England

[73] Assignee: DE La Rue Systems, Ltd., England

[21] Appl. No.: 339,018

[22] Filed: Apr. 14, 1989

[30] Foreign Application Priority Data

Apr. 14, 1988 [GB] United Kingdom ..... 8808841

[51] Int. Cl.[5] ..... B65H 7/12

[52] U.S. Cl. ..... 271/262; 271/263; 271/272; 271/273; 271/274

[58] Field of Search ..... 271/263, 262, 272, 273, 271/274, 258, 264

[56] References Cited

U.S. PATENT DOCUMENTS 2,303,681 12/1942 Buccicone ..... 271/262 X
4,420,151 12/1983 Kobayashi ..... 271/263
4,579,334 4/1986 Durajczyk et al. ..... 271/263

FOREIGN PATENT DOCUMENTS 0133818 8/1984 European Pat. Off. .
0186442 12/1985 European Pat. Off. .
1518389 10/1976 United Kingdom .

*Primary Examiner*—David H. Bollinger
*Attorney, Agent, or Firm*—Ostrolenk, Faber, Gerb & Soffen

[57] ABSTRACT

Sheet feeding apparatus for use in a sheet thickness monitoring system comprises a pair of rollers (1, 5) which define a nip or gap (25) therebetween, the rotation of the rollers (1, 5) causing sheets to be fed between the rollers. The passage of a sheet between the rollers (1, 5) causes deflection of one roller (5) relative to the other (1) by an amount related to the sheet thickness. The one roller (5) is biassed into engagement with the other roller (1). The apparatus further comprises elastomeric plugs (13, 14) for damping movement of the one roller (5) under the influence of the bias.

6 Claims, 1 Drawing Sheet

SHEET FEEDING APPARATUS

FIELD OF THE INVENTION

The invention relates to sheet feeding apparatus for use in a sheet thickness monitoring system, the apparatus being of the kind comprising a pair of rollers which define a nip or gap therebetween, the rotation of the rollers causing sheets to be fed between the rollers whereby the passage of a sheet between the rollers causes deflection of one roller relative to the other by an amount related to the sheet thickness; and biasing means for urging the one roller into engagement with the other roller. Such apparatus is hereinafter referred to as of the kind described.

DESCRIPTION OF THE PRIOR ART

When sheet feeding apparatus of the kind described is incorporated in a sheet thickness monitoring system, the deflection of the one roller is monitored and this is used to determine the thickness of the sheets passing through the nip for the purpose of counting, doubles detection, cornerfold detection and the like. There are many examples of sheet feeding apparatus of the kind described, for example EP-A-0186442 and GB-A-1518389.

One of the problems with the known sheet feeding apparatus is that after a sheet has passed through the nip, the one roller is forced back into contact with the other roller under the influence of the biasing means and this impact is noisy and the loads imparted to the support bearings reduce bearing life. Both these problems are particularly apparent in banknote handling machines which process large numbers of sheets (banknotes) usually in an environment where other machines are present as well as human operators.

SUMMARY OF THE INVENTION

In accordance with the present invention, sheet feeding apparatus of the kind described further comprises first damping means for damping movement of the one roller under the influence of the biasing means.

We have found that it is possible to damp the return movement of the one roller under the influence of the biasing means and thereby considerably reduce the noise of impact between the rollers leading to a more acceptable working environment and increase bearing life.

The invention is particularly useful in cases where the one roller is mounted on a shaft supported in a housing in such a manner that deflection of the roller upon the passage of a sheet through the nip causes deflection of the shaft. In this latter case, each end of the shaft or only one end may be mounted to the housing to permit deflection movement, the or each end cooperating with the first mounting means.

Typically, the first damping means comprises a resilient material such as rubber.

In the case where the one roller causes deflection movement of the shaft, the or each end of the shaft which is mounted for such deflection movement to the housing is preferably urged by the biasing means into engagement with the first damping means.

In one example, at least one end of the shaft carrying the one roller is supported in a mounting block of the housing and is urged by the biasing means against a plug of resilient material defining the first damping means.

Preferably, the sheet feeding apparatus is arranged such that the two rollers are just out of contact when no sheet is being fed between the rollers.

Conveniently, the apparatus further comprises second damping means for damping deflection movement of the one roller. The second damping means could comprise an auxiliary roller around the periphery of which is provided a cover of resilient material, for example a rubber tyre, which contacts the one roller. Preferably, two such auxiliary rollers are provided one at each end of the one roller. In either case, it is particularly convenient to drive the one roller via the auxiliary roller which is connected, in use, to a drive motor.

Typically, the biasing means comprises a compression spring although other forms of biasing means such as a tension spring, blocks of resilient material, or an hydraulic or pneumatic system could also be used.

BRIEF DESCRIPTION OF THE DRAWINGS

An example of sheet feeding apparatus according to the invention will now be described with reference to the accompanying drawings, in which.

DETAILED DESCRIPTION OF AN EMBODIMENT

Figure 1:
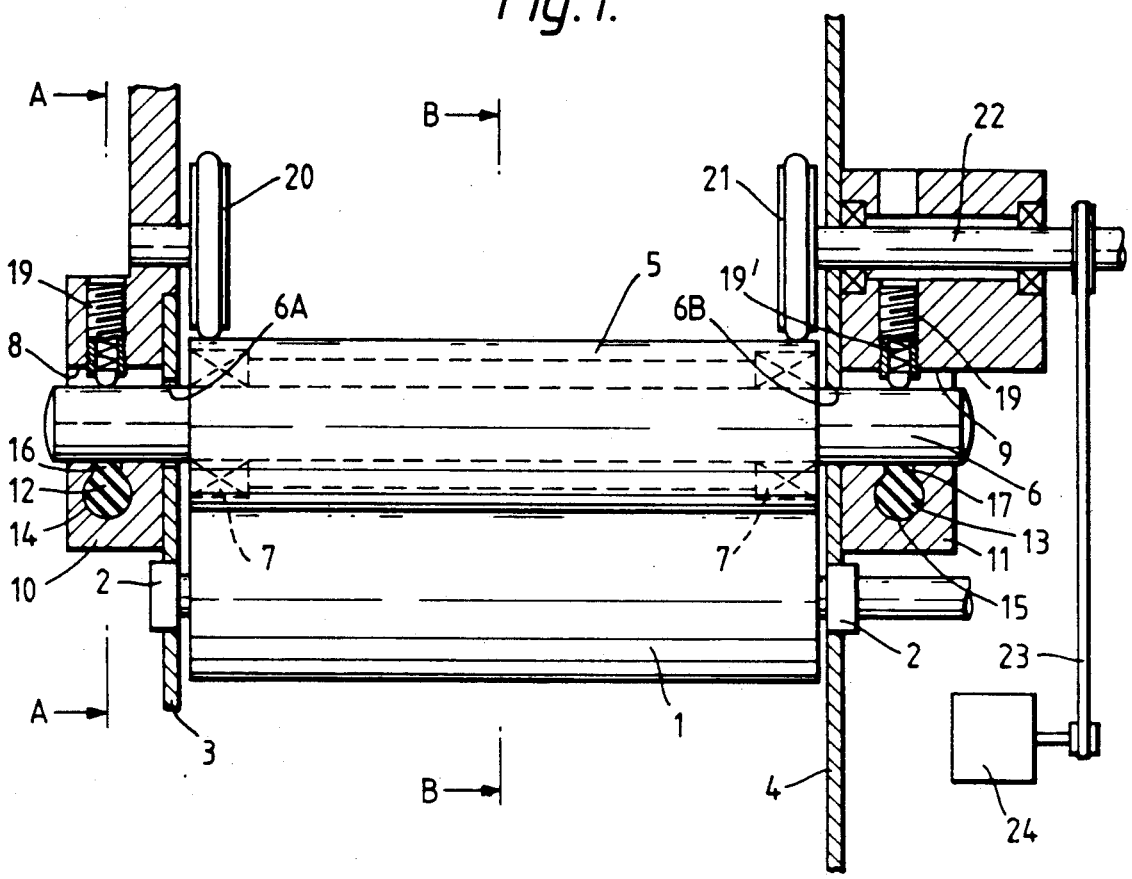
FIG. 1 is a schematic end elevation of the apparatus.

The apparatus comprises a solid precision ground steel reference roller 1 supported between two rigidly mounted ball bearings 2 in side walls 3, 4 of a housing. A sensor roller 5 formed by a precision ground hollow steel roller is mounted above the reference roller 1 via a ground steel shaft 6 to which it is rotatably mounted by a pair of ball bearings 7.

The shaft 6 extends through a pair of slots 6A, 6B in the walls 3, 4, each end of the shaft being received in respective apertures 8, 9 of mounting blocks 10, 11 fixed to the walls 3, 4.

Figure 2:
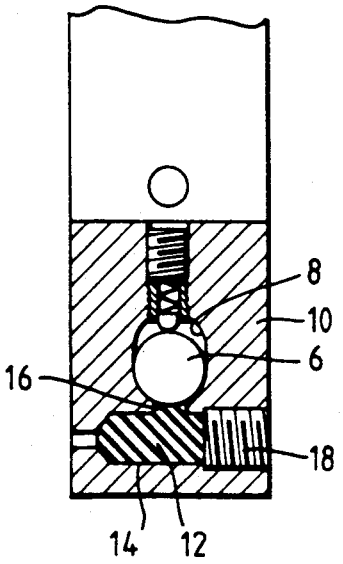
FIG. 2 is a section taken on the line A—A in FIG. 1.

In each mounting block 10, 11 the shaft 6 rests on a respective rubber plug 12, 13 housed within respective transverse cylindrical blind bores 14, 15. Each bore 14, 15 has an upwardly extending cylindrical port 16, 17 which opens into the respective slots 8, 9. The open ends of the bores 14, 15 are screw threaded and fitted with grub screws one of which 18 is shown in FIG. 2.

Above each end of the shaft 6 is mounted a vertically movable plunger 19 which is urged under the action of a compression spring 19' (only one shown) against the respective ends of the shaft 6 with a force which is manually adjustable.

The grub screws 158 are tightened to compress the rubber plugs 14, 15 to a sufficient extent that rubber protrudes through the cylindrical ports 16, 17 into the slots 8, 9 to engage the ends of the shaft 6 so as to separate slightly the roller 5 from the roller 1.

Above the roller 5 are mounted a pair of rubber tyred pulleys 20, 21 which engage the roller 5. The pulley 20 is rotatably mounted to the wa 3 when the pulley 21 is rotatably mounted to the wall 4 via a shaft 22 extending through the mounting block 11. The shaft 22 is driven via a belt 23 and drive motor 24 to rotate the pulley 21 which in turn will rotate the roller 5.

Figure 3:
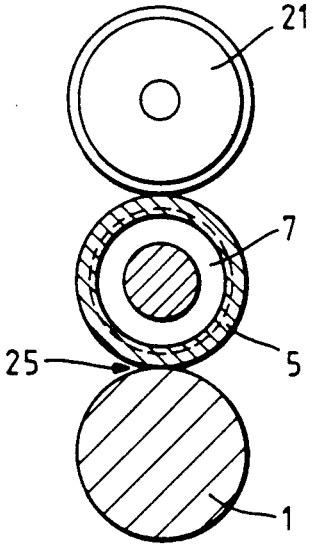
FIG. 3 is a section taken on the line B—B in FIG. 1.

In operation, sheets are fed by a conveying system of a conventional form (not shown) to the gap 25 between the rollers 1, 5. See FIG. 3. As already explained the rollers 1, 5 are separated slightly so that they are just out of contact. The motor 24 rotates the pulley 21 thus driving the roller 5, due to the frictional engagement of the pulley tyre with the roller, to feed sheets through the gap 25. The passage of a sheet such as a banknote between the roller 1, 5 will cause the roller 5 to deflect, forcing the shaft 6 in a vertically upward direction against the spring action of the plungers 19. Upward movement of the roller 5 is damped by the rotating rubber tyred pulleys 20, 21 and is also limited by the forces applied by the spring loaded plungers 19. This upward movement is monitored by a sheet monitoring system (not shown) in a conventional manner. For example, the monitoring system of EP-A-0186442 could be used, which is incorporated herein by reference.

After a note has passed through the gap 25, the roller 5 will be urged back towards the position shown in FIG. 1 under the influence of the plungers 19 and springs 19'. This movement will be damped, however, since the ends of the shaft 6 will engage the protruding portions of the rubber plugs 13, 14 before the surface of the roller 5 engages the roller 1. This will reduce considerably wear on the ball bearing 7 and also the noise of the impact between the rollers 1 and 5.

In should be noted that although FIG. 1 shows a single pair of rollers, each of the rollers 1, 5 could be divided into a number of subsidiary rollers laterally spaced apart, at least the subsidiary rollers corresponding to the roller 5 being drivingly coupled together.

I claim:

1. Sheet feeding apparatus for use in a sheet thickness monitoring system, the apparatus comprising:

first and second roller which define a nip or gap therebetween, the rotation of said rollers causing sheets to be fed between said rollers;

means for mounting said first roller so that the passage of a sheet between said rollers causes deflection of said first roller relative to said second roller by an amount related to the sheet thickness;

biasing means for urging said first roller into engagement with said second roller;

first damping means for damping movement of said first roller toward said second roller under the influence of said biasing means;

second damping means for damping deflection movement of said first roller, said second damping means comprising a resilient material, said second damping means including an auxiliary roller having said resilient material around a periphery thereof with said resilient material contacting said first roller; and said first roller having opposed ends, said second damping means further including a second auxiliary roller, said first and second auxiliary rollers being located at the opposed ends of said first roller.

2. Apparatus according to claim 1 wherein said biasing means comprises a compression spring.

3. Sheet feeding apparatus for use in a sheet thickness monitoring system, the apparatus comprising:

first and second rollers which define a nip or gap therebetween, the rotation of said rollers causing sheets to be fed between said rollers;

means for mounting said first roller so that the passage of a sheet between said rollers causes deflection of said first roller relative to said second roller by an amount related to the sheet thickness;

biasing means for urging said first roller into engagement with said second roller;

first damping means for damping movement of said first roller toward said second roller under the influence of said biasing means; resilient material, said second damping means including an auxiliary roller having said resilient material around a periphery thereof with said resilient material contacting said first roller; and a drive motor, said auxiliary roller being coupled with said drive motor to drive said first roller.

4. Apparatus according to claim 3 wherein said biasing means comprises a compression spring.

5. Sheet feeding apparatus for use in a sheet thickness monitoring system, the apparatus comprising:

first and second rollers which define a nip or gap therebetween, the rotation of said rollers causing sheets to be fed between said rollers;

means for mounting said first roller so that the passage of a sheet between said rollers causes deflection of said first roller relative to said second roller by an amount related to the sheet thickness;

biasing means for urging said first roller into engagement with said second roller;

first damping means for damping movement of said first roller toward said second roller under the influence of said biasing means;

a housing, said means for mounting said first roller being effective to mount said first roller on a shaft supported in said housing in such a manner that deflection of said first roller upon the passage of a sheet between said first and second rollers causes deflection of said shaft relative to said housing; and at least one end of said shaft carrying said first roller being supported in a mounting block of said housing and being urged by said biasing means against a plug of resilient material defining said first damping means.

6. Apparatus according to claim 5 wherein said biasing means comprises a compression spring.

* * * * *